US011492776B1

(12) United States Patent
Antonelli

(10) Patent No.: US 11,492,776 B1
(45) Date of Patent: Nov. 8, 2022

(54) EXCAVATOR BUCKET WITH RETRACTABLE TEETH

(71) Applicant: Ralph Antonelli, W Milford, NJ (US)

(72) Inventor: Ralph Antonelli, W Milford, NJ (US)

( * ) Notice: Subject to any disclaimer, the term of this patent is extended or adjusted under 35 U.S.C. 154(b) by 249 days.

(21) Appl. No.: 16/820,862

(22) Filed: Mar. 17, 2020

(51) Int. Cl.
*E02F 3/40* (2006.01)

(52) U.S. Cl.
CPC ..... *E02F 3/404* (2013.01)

(58) Field of Classification Search
CPC ... E02F 3/404; E02F 3/405; E02F 3/40; E02F 3/401
USPC ..... 37/903, 447
See application file for complete search history.

(56) References Cited

U.S. PATENT DOCUMENTS 2,042,196 A * 5/1936 Senz ..... E02F 3/8155 172/777
2,694,354 A * 11/1954 Roberg ..... E02F 5/326 172/423
2,838,856 A * 6/1958 Buisse ..... E02F 3/405 37/404
2,850,815 A * 9/1958 Edwards ..... E02F 3/405 37/447
2,899,760 A * 8/1959 Armington et al. .. E02F 3/7604 172/777
3,048,292 A * 8/1962 Kohorst ..... E02F 3/407 414/725
3,065,557 A 11/1962 Pewthers
3,269,039 A * 8/1966 Bodiue ..... E02F 3/64 37/411
3,305,953 A * 2/1967 Von Mehren ..... E02F 3/405 37/414
3,328,904 A * 7/1967 Voigt ..... E02F 3/405 37/447
3,645,021 A * 2/1972 Sonerud ..... E02F 3/405 37/447
3,677,604 A * 7/1972 Leyrat ..... E02F 3/405 299/67
3,828,951 A * 8/1974 Fleming ..... E02F 3/405 414/694
3,864,852 A * 2/1975 Lochrie ..... B06B 1/183 37/414
4,467,539 A * 8/1984 Gurries ..... E02F 3/405 172/40

(Continued)

FOREIGN PATENT DOCUMENTS

CA 2968761 11/2018

*Primary Examiner* — Jamie L McGowan

(57) ABSTRACT

The excavator bucket with retractable teeth is a mechanical structure. The excavator bucket with retractable teeth forms the working element of an excavator. The excavator bucket with retractable teeth comprises an excavator bucket and a hydraulic structure. The hydraulic structure installs in the excavator bucket. The excavator bucket is a pan used to receive and transport soil removed from the ground. The hydraulic structure is a toothed structure used to break up the ground before excavating the soil into the excavator bucket. The hydraulic structure moves between a deployed position and a retracted position. In the deployed position, the hydraulic structure presents a plurality of individual tooth structures used to break up the ground. In the retracted position, the plurality of individual tooth structures are fully enclosed in the excavator bucket such that the excavation process proceeds without the benefit of the plurality of individual tooth structures.

16 Claims, 4 Drawing Sheets

(56) References Cited

U.S. PATENT DOCUMENTS

| | | | | | |
|---|---|---|---|---|---|
| 4,512,090 | A | | 4/1985 | Billings | |
| 4,550,512 | A | | 11/1985 | Feistet | |
| 4,625,438 | A | * | 12/1986 | Mozer | E02F 3/405 37/414 |
| 4,729,180 | A | | 3/1988 | Hendricks | |
| 4,967,850 | A | * | 11/1990 | Bargfrede | E02F 3/815 172/197 |
| 5,564,885 | A | * | 10/1996 | Staben, Jr. | E02F 3/962 414/724 |
| 6,460,276 | B1 | * | 10/2002 | Ireland | E02F 3/405 37/444 |
| 6,572,324 | B2 | * | 6/2003 | Ihm | E02F 3/407 37/405 |
| 6,574,891 | B1 | * | 6/2003 | Ireland | E02F 3/405 37/403 |
| 7,891,121 | B2 | * | 2/2011 | Smoljo | E02F 3/8155 37/447 |
| D656,522 | S | | 3/2012 | Elliott | |
| 8,875,420 | B2 | * | 11/2014 | Paull | E02F 9/265 37/404 |
| 8,875,421 | B2 | * | 11/2014 | Paull | E02F 3/401 37/404 |
| 9,015,967 | B2 | * | 4/2015 | May | E02F 3/7631 37/405 |
| 9,506,215 | B2 | | 11/2016 | Kreil | |
| 2002/0194754 | A1 | * | 12/2002 | Brown | E02F 3/65 37/446 |
| 2006/0017313 | A1 | * | 1/2006 | Gagnon | E02F 3/405 299/37.1 |
| 2012/0186112 | A1 | * | 7/2012 | Tulibaski | E02F 3/404 37/407 |

* cited by examiner

EXCAVATOR BUCKET WITH RETRACTABLE TEETH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed constructions including hydraulic engineering and soil shifting, more specifically, the form and geometry of a grab bucket device. (E02F3/40)

SUMMARY OF INVENTION

The excavator bucket with retractable teeth is a mechanical structure. The excavator bucket with retractable teeth forms the working element of an excavator. The excavator is a mechanical device used to dig holes in the ground. The excavator bucket with retractable teeth comprises an excavator bucket and a hydraulic structure. The hydraulic structure installs in the excavator bucket. The excavator bucket is a pan used to receive and transport soil removed from the ground. The hydraulic structure is a toothed structure used to break up the ground before excavating the soil into the excavator bucket. The hydraulic structure moves between a deployed position and a retracted position. In the deployed position, the hydraulic structure presents a plurality of individual tooth structures used to break up the ground. In the retracted position, the plurality of individual tooth structures are fully enclosed in the excavator bucket such that the excavation process proceeds without the benefit of the plurality of individual tooth structures.

These together with additional objects, features and advantages of the excavator bucket with retractable teeth will be readily apparent to those of ordinary skill in the art upon reading the following detailed description of the presently preferred, but nonetheless illustrative, embodiments when taken in conjunction with the accompanying drawings.

In this respect, before explaining the current embodiments of the excavator bucket with retractable teeth in detail, it is to be understood that the excavator bucket with retractable teeth is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the excavator bucket with retractable teeth.

It is therefore important that the claims be regarded as including such equivalent construction insofar as they do not depart from the spirit and scope of the excavator bucket with retractable teeth. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
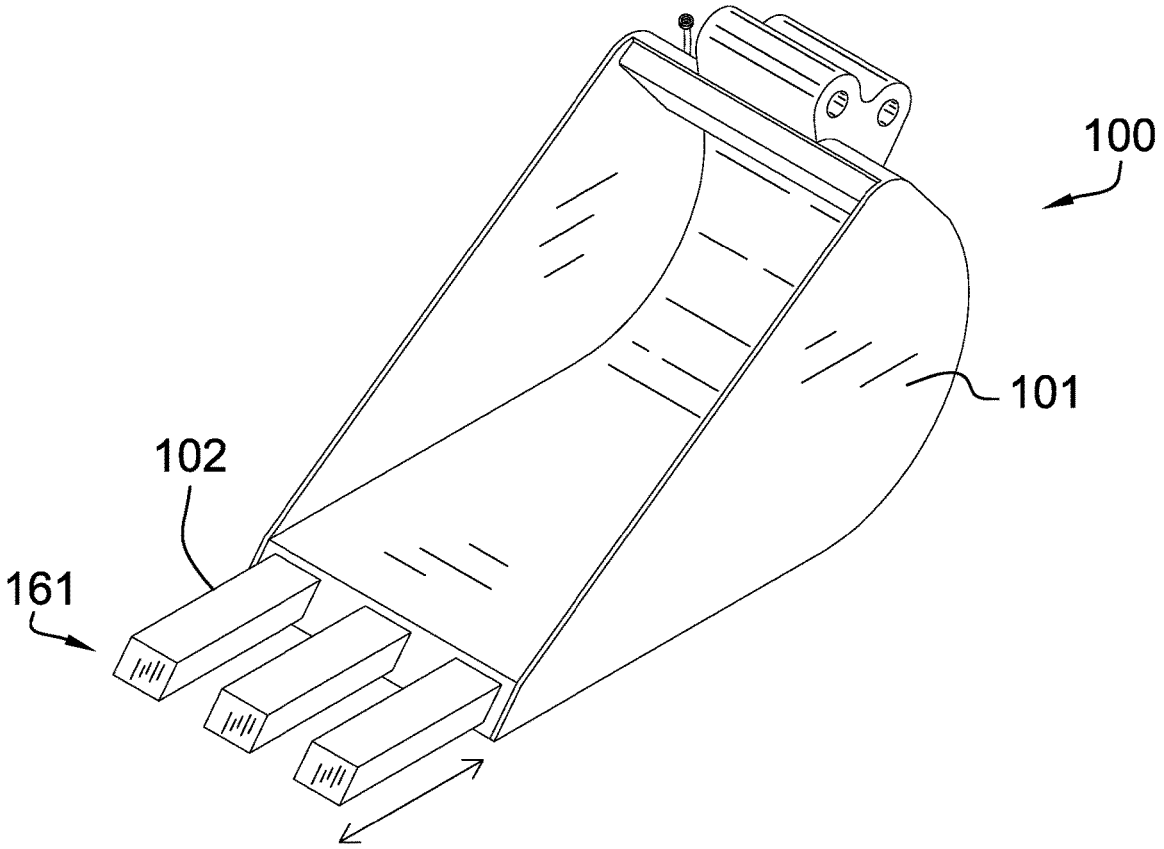
FIG. 1 is a perspective deployed view of an embodiment of the disclosure.
Figure 2:
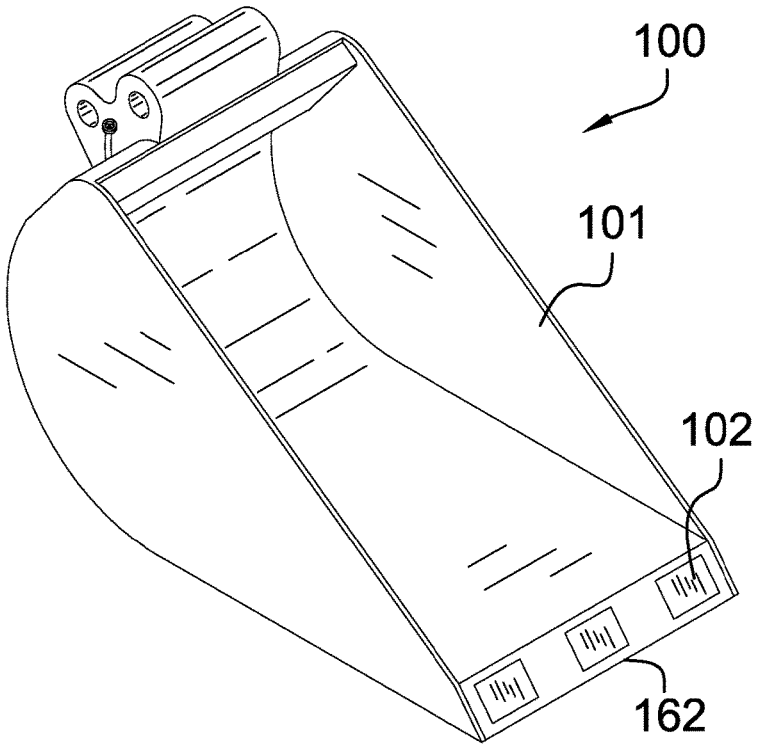
FIG. 2 is a perspective retracted view of an embodiment of the disclosure.
Figure 3:
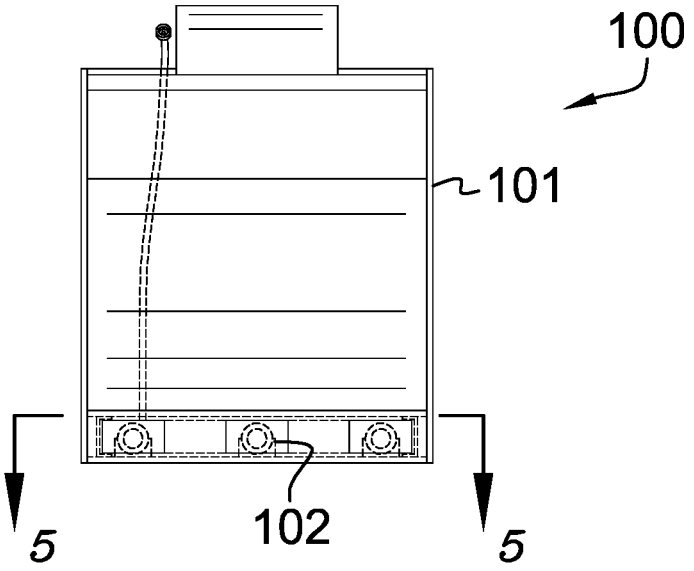
FIG. 3 is a front view of an embodiment of the disclosure.
Figure 4:
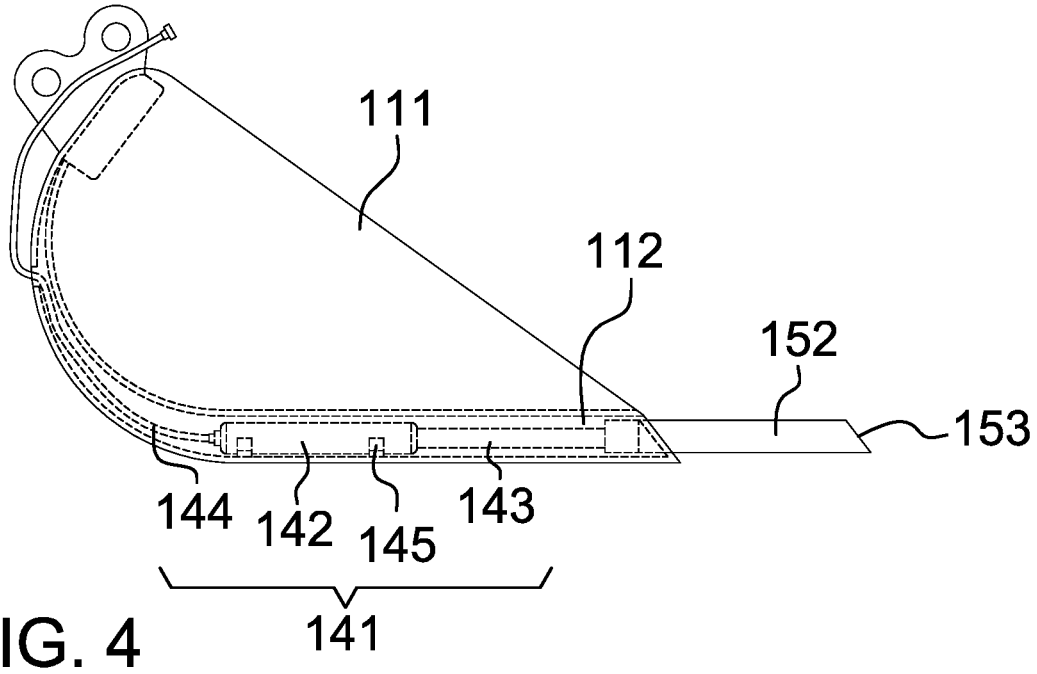
FIG. 4 is a side view of an embodiment of the disclosure.
Figure 5:
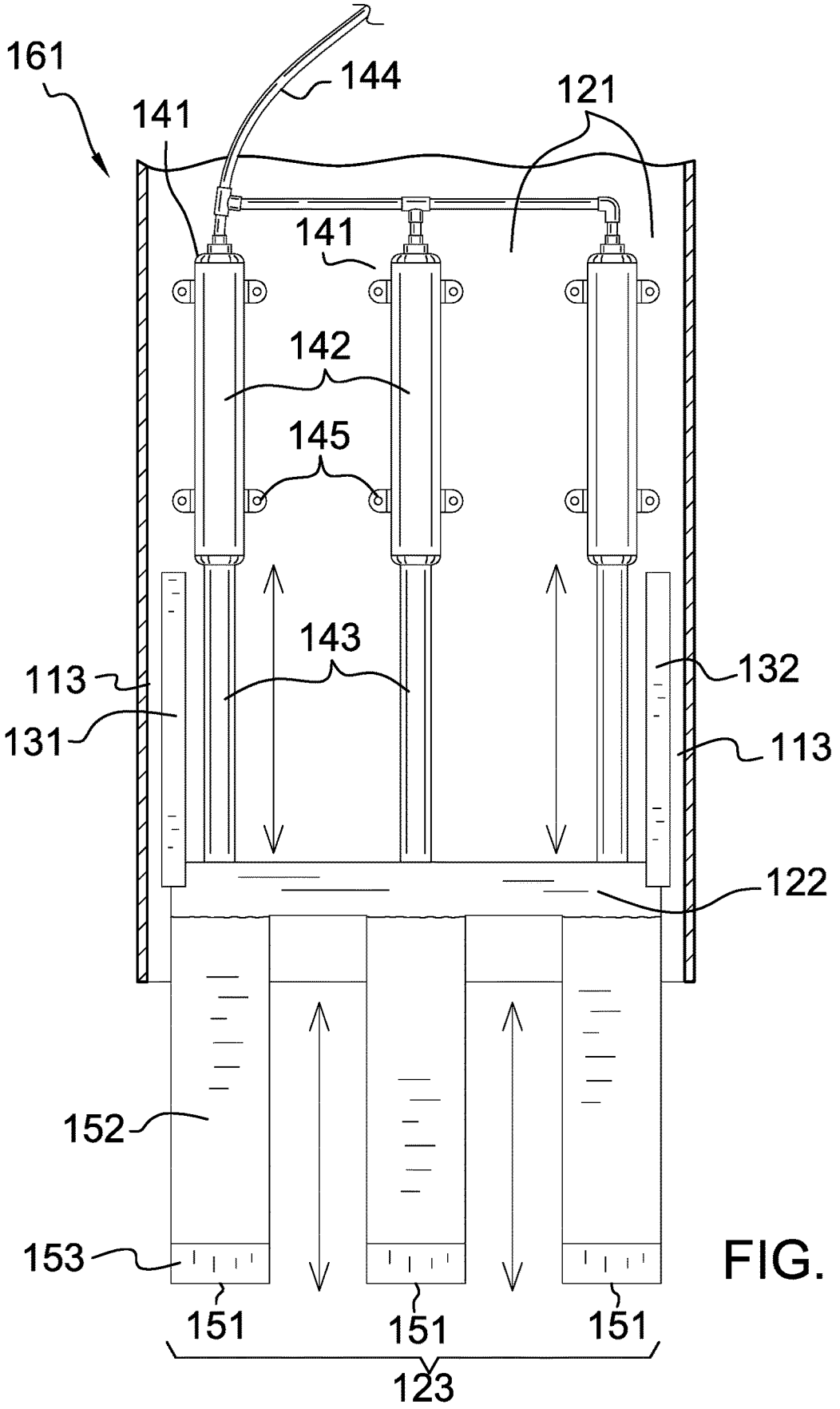
FIG. 5 is a cross-sectional deployed view of an embodiment of the disclosure across 5-5 as shown in FIG. 3.
Figure 6:
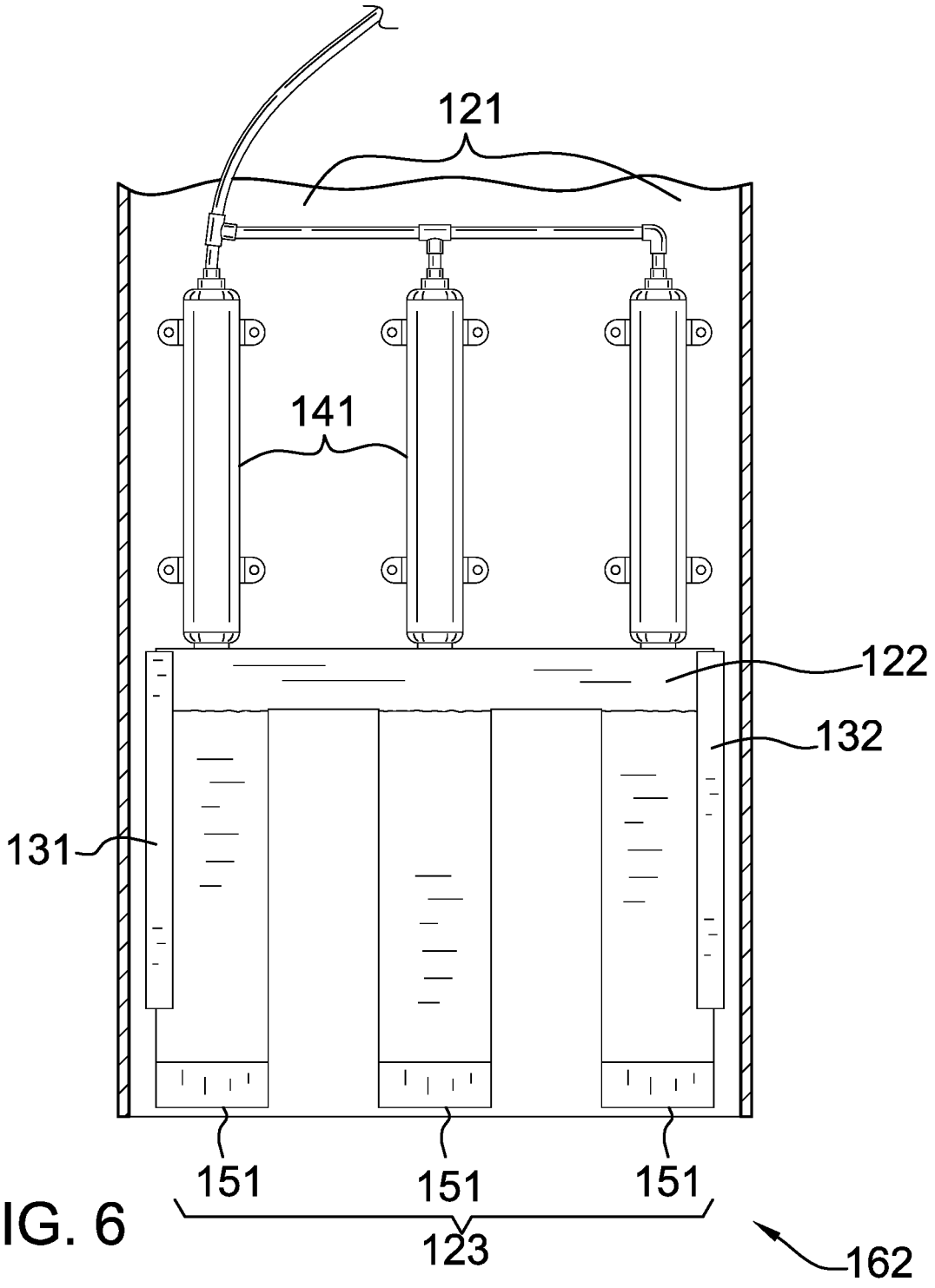
FIG. 6 is a cross-sectional retracted view of an embodiment of the disclosure across 5-5 as shown in FIG. 3.

Detailed reference will now be made to one or more potential embodiments of the disclosure, which are illustrated in FIGS. 1 through 6.

The excavator bucket with retractable teeth 100 (hereinafter invention) is a mechanical structure. The invention 100 forms the working element of an excavator. The excavator is a mechanical device used to dig holes in the ground. The invention 100 comprises an excavator bucket 101 and a hydraulic structure 102. The hydraulic structure 102 installs in the excavator bucket 101. The excavator bucket 101 is a pan used to receive and transport soil removed from the ground. The hydraulic structure 102 is a toothed structure used to break up the ground before excavating the soil into the excavator bucket 101. The hydraulic structure 102 moves between a deployed position 161 and a retracted position 162. In the deployed position 161, the hydraulic structure 102 presents a plurality of individual tooth structures 123 used to break up the ground. In the retracted position 162, the plurality of individual tooth structures 123 are fully enclosed in the excavator bucket 101 such that the excavation process proceeds without the benefit of the plurality of individual tooth structures 123.

The excavator bucket 101 is a prism-shaped structure. The excavator bucket 101 is formed as a pan. The excavator bucket 101 is a containment structure. The excavator bucket 101 transports soil removed from the ground for subsequent disposal. The excavator bucket 101: a) is pushed into the ground; b) captures soil from the ground; and, c) removes the soil from the ground. The excavator bucket 101 comprises a bucket structure 111, an inferior housing 112, and a tracking system 113.

The bucket structure 111 is a rigid structure. The bucket structure 111 is a prism-shaped structure. The bucket structure 111 is formed as a pan. The bucket structure 111 is a containment structure. The bucket structure 111 physically captures, contains, and moves the soil captured from the ground.

The inferior housing 112 is a hollow structure formed within the bucket structure 111. The inferior housing 112 forms a rigid casing. The inferior housing 112 contains the hydraulic structure 102. The inferior housing 112 is formed with all apertures and form factors necessary to allow the inferior housing 112 to accommodate the use and operation of the hydraulic structure 102. Methods to form housing suitable for the purposes described in this disclosure are well-known and documented in the mechanical arts.

The tracking system 113 is a mechanical structure built within the inferior housing 112. The tracking system 113 guides the motion of the hydraulic structure 102 as the hydraulic structure 102 moves between the deployed position 161 and the retracted position 162. The tracking system 113 comprises a first c-channel 131 and a second c-channel 132.

The first c-channel 131 is a c-channel. The c-channel is defined elsewhere in this disclosure. The first c-channel 131 is sized such that the congruent end of the crossbeam 122 of the hydraulic structure 102 fits into the hollow interior of the first c-channel 131. The first c-channel 131 guides the motion of the crossbeam 122 through the inferior housing 112 as the hydraulic structure 102 transitions between the deployed position 161 and the retracted position 162. The second c-channel 132 is a c-channel. The c-channel is defined elsewhere in this disclosure. The second c-channel 132 is sized such that the congruent end of the crossbeam 122 of the hydraulic structure 102 that is distal from the first c-channel 131 fits into the hollow interior of the second c-channel 132. The second c-channel 132 guides the motion of the crossbeam 122 through the inferior housing 112 as the hydraulic structure 102 transitions between the deployed position 161 and the retracted position 162.

The hydraulic structure 102 is a mechanical structure. The hydraulic structure 102 is further defined with a deployed position 161 and a retracted position 162. The hydraulic structure 102 transitions between a deployed position 161 and a retracted position 162. In the deployed position 161, the hydraulic structure 102 breaks up the ground as the excavator bucket 101 captures the soil from the ground. In the retracted position 162, the excavator bucket 101 captures the soil from the ground without the benefit of the operation of the hydraulic structure 102. The hydraulic structure 102 comprises a plurality of hydraulic mechanisms 121, a crossbeam 122, and a plurality of individual tooth structures 123.

Each hydraulic mechanism selected from the plurality of hydraulic mechanisms 121 is a hydraulic device. Each hydraulic mechanism selected from the plurality of hydraulic mechanisms 121 is a moving structure. Each hydraulic mechanism selected from the plurality of hydraulic mechanisms 121 provides a portion of the motive forces necessary to move the plurality of individual tooth structures 123 between the deployed position 161 and the retracted position 162. Each hydraulic mechanism selected from the plurality of hydraulic mechanisms 121 is identical. The plurality of hydraulic mechanisms 121 comprises a collection of individual hydraulic mechanisms 141.

Each individual hydraulic mechanism 141 comprises a hydraulic prism 142, a hydraulic piston 143, and a hydraulic fluid line 144.

Each individual hydraulic mechanism 141 is a mechanical structure. Each individual hydraulic mechanism 141 is a hydraulic device. Each individual hydraulic mechanism 141 forms a device that converts a change in pressure of a hydraulic fluid into a motive force capable of generating linear motion. Each individual hydraulic mechanism 141 transfers motive forces to the crossbeam 122 of the hydraulic structure 102 such that the crossbeam 122 and the plurality of individual tooth structures 123 move within the inferior housing 112 of the excavator bucket 101. Each individual hydraulic mechanism 141 generates the motive forces that move the crossbeam 122 of the hydraulic structure 102 along the track formed by the first c-channel 131 and the second c-channel 132 of the tracking system 113 of the excavator bucket 101.

The hydraulic prism 142 is a hollow prism-shaped structure. The hydraulic prism 142 forms a containment structure that receives hydraulic fluid under pressure. The hydraulic prism 142 transfers the motive forces generated by the pressurized hydraulic fluid to the hydraulic piston 143. The hydraulic prism 142 further comprises a hydraulic prism 142 mount 145. The hydraulic prism 142 mount 145 is a mechanical structure that attaches the hydraulic prism 142 to the inferior housing 112 of the excavator bucket 101 such that the hydraulic prism 142 remains within a fixed position within the inferior housing 112.

The hydraulic piston 143 is a piston that moves within the hydraulic prism 142 of the individual hydraulic mechanism 141. An end of the hydraulic piston 143, known as the free end, extends beyond the exterior surfaces of the hydraulic prism 142. The free end of the hydraulic piston 143 of each individual hydraulic mechanism 141 attaches to the first lateral face of the crossbeam 122. The center axis of the free end of the hydraulic piston 143 is perpendicular to the first lateral face of the crossbeam 122. The hydraulic piston 143 transfers the motive forces generated by the pressurized hydraulic fluid to the crossbeam 122 as a linear force.

The hydraulic fluid line 144 forms a fluidic connection between the hydraulic prism 142 and a source of pressurized hydraulic fluid. The hydraulic fluid line 144 transfers the pressurized hydraulic fluid into and out of the hydraulic prism 142 in order to transition the hydraulic structure 102 between the deployed position 161 and the retracted position 162.

The crossbeam 122 is a rigid structure. The crossbeam 122 is a prism-shaped structure. The crossbeam 122 is an interface structure that attaches the plurality of hydraulic mechanisms 121 to the plurality of individual tooth structures 123. The crossbeam 122 forms the load path that transfers the motive forces generated by the plurality of hydraulic mechanisms 121 to the plurality of individual tooth structures 123 that allow the plurality of individual tooth structures 123 to transition between the deployed position 161 and the retracted position 162.

Each of the plurality of hydraulic mechanisms 121 attaches to a first lateral face of the crossbeam 122. Each of the plurality of individual tooth structures 123 attaches to the lateral face of the crossbeam 122 that is distal from the first lateral face of the crossbeam 122. The rigid structure of the crossbeam 122 evenly transmits the motive forces generated by the plurality of hydraulic mechanisms 121 to the plurality of individual tooth structures 123.

The crossbeam 122 attaches to the tracking system 113 such that the tracking system 113 guides the linear motion of the crossbeam 122 during the transition between the deployed position 161 and the retracted position 162 of the hydraulic structure 102.

Each of the plurality of individual tooth structures 123 is a mechanical structure. Each of the plurality of individual tooth structures 123 is identical. In the deployed position 161 each of the plurality of individual tooth structures 123 extends beyond the exterior of the pan structure of the bucket structure 111 of the excavator bucket 101 such that the plurality of individual tooth structures 123 lead the bucket structure 111 into the ground. The end of each of the plurality of individual tooth structures 123 forms a blade that breaks up the ground as the bucket structure 111 enters the ground. In the retracted position 162 each of the plurality of individual tooth structures 123 is fully contained within the exterior surfaces of the of the pan structure of the bucket structure 111 of the excavator bucket 101 such that the benefits of the plurality of individual tooth structures 123 are not available to the bucket structure 111 as the bucket structure 111 enters into the ground.

The plurality of individual tooth structures 123 comprises a collection of individual tooth structures 151.

Each individual tooth structure 151 selected from the plurality of individual tooth structures 123 is a mechanical structure. Each selected individual tooth structure 151 is identical. Each selected individual tooth structure 151 forms a working element of the invention 100. Each selected individual tooth structure 151 cuts into the ground such that each selected individual tooth structure 151 breaks up the soil as the bucket structure 111 of the excavator bucket 101 enters the ground.

Each selected individual tooth structure 151 fully retracts into the inferior housing 112 of the excavator bucket 101 when the hydraulic structure 102 is in the retracted position 162. Each selected individual tooth structure 151 extends beyond the exterior surfaces of the inferior housing 112 of the excavator bucket 101 when the hydraulic structure 102 is in the deployed position 161. Each selected individual tooth structure 151 leads the bucket structure 111 of the excavator bucket 101 into the ground when the hydraulic structure 102 is in the deployed position 161.

Each individual tooth structure 151 comprises a root 152 and a crown 153.

The root 152 is a prism-shaped structure. The root 152 is a rigid structure. The root 152 attaches the crown 153 to the crossbeam 122 of the hydraulic structure 102. A congruent end of the prism structure of the root 152 attaches to the lateral face of the crossbeam 122 that is distal from the lateral face on which the hydraulic piston 143 of each individual hydraulic mechanism 141 of the plurality of hydraulic mechanisms 121 attaches. The root 152 attaches to the lateral face of the crossbeam 122 such that the center axis of the prism structure of the root 152 is perpendicular to the lateral face of the crossbeam 122.

The crown 153 is a wedge shaped structure. The crown 153 is a rigid structure. The crown 153 attaches to the congruent end of the prism structure of the root 152 that is distal from the crossbeam 122. The crown 153 forms the cutting edge of the working element of the hydraulic structure 102 that breaks up the ground when the hydraulic structure 102 is in the deployed position 161. The crown 153 is fully contained within the inferior housing 112 when the hydraulic structure 102 is in the retracted position 162.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Blade: As used in this disclosure, a blade is a term that is used to describe: 1) a wide and flat portion of a structure; or, 2) the cutting edge of a tool.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Housing: As used in this disclosure, a housing is a rigid structure that encloses and protects one or more devices.

Hydraulic: As used in this disclosure, hydraulic refers to a device wherein the movement of the device is powered using a fluid under pressure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) an end of the prism structure that forms the pan; and, b) a lateral face of the prism structure that forms the pan. A semi-enclosed pan refers to a pan wherein the closed end of prism structure of the pan and/or a portion of the lateral face of the pan is also open.

Perimeter: As used in this disclosure, a perimeter is one or more curved or straight lines that bounds an enclosed area on a plane or surface. The perimeter of a circle is commonly referred to as a circumference.

Piston: As used in this disclosure, a piston is a prism or disk that closely fits within a pipe or tube and that moves along the center axis of the pipe or tube. Depending on the context, a piston can also refer to the apparatus associated with the disk that allows the disk to move within the pipe or tube.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rigid Structure: As used in this disclosure, a rigid structure is a solid structure formed from an inelastic material that resists changes in shape. A rigid structure will permanently deform as it fails under a force. See bimodal flexible structure.

Rounded: A used in this disclosure, the term rounded refers to the replacement of an apex, vertex, or edge or brink of a structure with a (generally smooth) curvature wherein the concave portion of the curvature faces the interior or center of the structure.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Teeth: As used in this disclosure, the teeth refer to a plurality of working elements of a tool that interact with an object in order to cut the object. An individual working element selected form the plurality of working elements is called a tooth.

Tool: As used in this disclosure, a tool is a device, an apparatus, or an instrument that is used to carry out an activity, operation, or procedure.

Track: As used in this disclosure, a track is a physical structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Vertex: As used in this disclosure, a vertex (plural vertices) is an angle that is formed by two lines (or a plurality of surfaces) that form a point. Vertices are commonly found in polygons, prisms, and pyramids.

Wedge: As used in this disclosure, a wedge is a roughly triangular prism-shaped structure.

Working Element: As used in this disclosure, the working element of a tool is the physical element on the tool that performs the actual activity, operation, or procedure the tool is designed to perform. For example, the cutting edge of a blade is the working element of a knife.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hydraulic apparatus comprising an excavator bucket and a hydraulic structure;

wherein the hydraulic structure installs in the excavator bucket;

wherein the hydraulic structure is a toothed structure;

wherein the hydraulic structure is further defined with a deployed position and a retracted position;

wherein the excavator bucket comprises a bucket structure, an inferior housing, and a tracking system;

wherein the hydraulic structure comprises a plurality of hydraulic mechanisms, a crossbeam, and a plurality of individual tooth structures;

wherein the excavator bucket is a pan;

wherein the excavator bucket is a prism-shaped structure;

wherein the excavator bucket is a containment structure;

wherein the hydraulic structure is a mechanical structure;

wherein the hydraulic structure transitions between the deployed position and the retracted position;

wherein in the deployed position, the hydraulic structure presents a plurality of individual tooth structures;

wherein in the retracted position, the plurality of individual tooth structures are fully enclosed in the excavator bucket;

wherein the inferior housing installs in the bucket structure;

wherein the tracking system installs in the inferior housing;

wherein the plurality of hydraulic mechanisms comprises a collection of individual hydraulic mechanisms;

wherein each individual hydraulic mechanism selected from the plurality of hydraulic mechanisms provides a portion of the motive forces necessary to move the plurality of individual tooth structures between the deployed position and the retracted position;

wherein the crossbeam forms a load path that transfers the motive forces generated by the plurality of hydraulic mechanisms to the plurality of individual tooth structures that allow the plurality of individual tooth structures to transition between the deployed position and the retracted position;

wherein each of the plurality of individual tooth structures is a mechanical structure;

wherein each of the plurality of individual tooth structures is identical;

wherein the end of each of the plurality of individual tooth structures forms a blade.

2. The hydraulic apparatus according to claim 1 wherein in the deployed position each of the plurality of individual tooth structures extends beyond the exterior of the pan structure of the bucket structure of the excavator bucket such that the plurality of individual tooth structures lead the bucket structure into the ground;

wherein in the retracted position each of the plurality of individual tooth structures is fully contained within the exterior surfaces of the of the pan structure of the bucket structure of the excavator bucket such that the benefits of the plurality of individual tooth structures are not available to the bucket structure as the bucket structure enters into the ground.

3. The hydraulic apparatus according to claim 2 wherein the bucket structure is a rigid structure;

wherein the bucket structure is a prism-shaped structure;

wherein the bucket structure is formed as a pan;

wherein the bucket structure is a containment structure.

4. The hydraulic apparatus according to claim 3 wherein the inferior housing is a hollow structure formed within the bucket structure;

wherein the inferior housing forms a rigid casing;

wherein the inferior housing contains the hydraulic structure.

5. The hydraulic apparatus according to claim 4 wherein the tracking system is a mechanical structure built within the inferior housing;

wherein the tracking system guides the motion of the hydraulic structure as the hydraulic structure transitions between the deployed position and the retracted position.

6. The hydraulic apparatus according to claim 5 wherein each individual hydraulic mechanism is a mechanical structure;

wherein each individual hydraulic mechanism is a hydraulic device;

wherein each individual hydraulic mechanism forms a device that converts a change in pressure of a hydraulic fluid into a motive force capable of generating linear motion;

wherein each individual hydraulic mechanism transfers motive forces to the crossbeam of the hydraulic structure such that the crossbeam and the plurality of individual tooth structures move within the inferior housing of the excavator bucket;

wherein each individual hydraulic mechanism generates the motive forces that move the crossbeam of the hydraulic structure along the track formed by the tracking system of the excavator bucket.

7. The hydraulic apparatus according to claim 6 wherein each individual hydraulic mechanism comprises a hydraulic prism, a hydraulic piston, and a hydraulic fluid line;

wherein the hydraulic prism transfers the motive forces generated by the pressurized hydraulic fluid to the hydraulic piston;

wherein the hydraulic piston is a piston that moves within the hydraulic prism of the individual hydraulic mechanism;

wherein the hydraulic fluid line forms a fluidic connection between the hydraulic prism and a source of pressurized hydraulic fluid.

8. The hydraulic apparatus according to claim 7 wherein the hydraulic prism is a hollow prism-shaped structure;

wherein the hydraulic prism forms a containment structure that receives hydraulic fluid under pressure.

9. The hydraulic apparatus according to claim 8 wherein an end of the hydraulic piston, known as the free end, extends beyond the exterior surfaces of the hydraulic prism;

wherein the free end of the hydraulic piston of each individual hydraulic mechanism attaches to a first lateral face of the crossbeam;

wherein the center axis of the free end of the hydraulic piston is perpendicular to the first lateral face of the crossbeam;

wherein the hydraulic piston transfers the motive forces generated by the pressurized hydraulic fluid to the crossbeam as a linear force.

10. The hydraulic apparatus according to claim 9 wherein the crossbeam is a rigid structure;

wherein the crossbeam is a prism-shaped structure;

wherein the crossbeam is an interface structure that attaches the plurality of hydraulic mechanisms to the plurality of individual tooth structures.

11. The hydraulic apparatus according to claim 10 wherein each of the plurality of individual tooth structures attaches to the lateral face of the crossbeam that is distal from the first lateral face of the crossbeam;

wherein the crossbeam attaches to the tracking system such that the tracking system guides the linear motion of the crossbeam during the transition between the deployed position and the retracted position of the hydraulic structure.

12. The hydraulic apparatus according to claim 11 wherein the plurality of individual tooth structures comprises a collection of individual tooth structures;

wherein each individual tooth structure selected from the plurality of individual tooth structures is a mechanical structure;

wherein each selected individual tooth structure is identical;

wherein each selected individual tooth structure forms a working element of the hydraulic apparatus.

13. The hydraulic apparatus according to claim 12 wherein each selected individual tooth structure fully retracts into the inferior housing of the excavator bucket when the hydraulic structure is in the retracted position;

wherein each selected individual tooth structure extends beyond the exterior surfaces of the inferior housing of the excavator bucket when the hydraulic structure is in the deployed position.

14. The hydraulic apparatus according to claim 13 wherein each individual tooth structure comprises a root and a crown;

wherein the root is a prism-shaped structure;

wherein the root is a rigid structure;

wherein the root attaches the crown to the crossbeam of the hydraulic structure;

wherein a congruent end of the prism structure of the root attaches to the lateral face of the crossbeam that is distal from the lateral face on which the hydraulic piston of each individual hydraulic mechanism of the plurality of hydraulic mechanisms attaches;

wherein the root attaches to the lateral face of the crossbeam such that the center axis of the prism structure of the root is perpendicular to the lateral face of the crossbeam;

wherein the crown is a wedge shaped structure;

wherein the crown is a rigid structure;

wherein the crown attaches to the congruent end of the prism structure of the root that is distal from the crossbeam;

wherein the crown forms the cutting edge of the working element of the hydraulic structure that breaks up the ground when the hydraulic structure is in the deployed position;

wherein the crown is fully contained within the inferior housing when the hydraulic structure is in the retracted position.

15. The hydraulic apparatus according to claim 14 wherein the tracking system comprises a first c-channel and a second c-channel;

wherein the first c-channel is a c-channel;

wherein the first c-channel is sized such that the congruent end of the crossbeam of the hydraulic structure fits into the hollow interior of the first c-channel;

wherein the first c-channel guides the motion of the crossbeam through the inferior housing as the hydraulic structure transitions between the deployed position and the retracted position;

wherein the second c-channel is a c-channel;

wherein the second c-channel is sized such that the congruent end of the crossbeam of the hydraulic structure that is distal from the first c-channel fits into the hollow interior of the second c-channel;

wherein the second c-channel guides the motion of the crossbeam through the inferior housing as the hydraulic structure transitions between the deployed position and the retracted position;

wherein each individual hydraulic mechanism generates the motive forces the move the crossbeam of the hydraulic structure along the track formed by the first c-channel and the second c-channel of the tracking system of the excavator bucket.

16. The hydraulic apparatus according to claim 15 wherein the hydraulic prism further comprises a hydraulic prism mount;

wherein the hydraulic prism mount is a mechanical structure that attaches the hydraulic prism to the inferior housing of the excavator bucket such that the hydraulic prism remains within a fixed position within the inferior housing.

* * * * *